US006840220B2

(12) United States Patent
Yomogida et al.

(10) Patent No.: US 6,840,220 B2
(45) Date of Patent: Jan. 11, 2005

(54) COMMON RAIL FUEL INJECTION CONTROL DEVICE

(75) Inventors: Koichiro Yomogida, Fujisawa (JP); Futoshi Nakano, Fujisawa (JP); Yusuke Saigo, Fujisawa (JP); Yuji Sasaki, Fujisawa (JP)

(73) Assignee: Isuzu Motors Limited, Tokyo (JP)

( * ) Notice: Subject to any disclaimer, the term of this patent is extended or adjusted under 35 U.S.C. 154(b) by 0 days.

(21) Appl. No.: 10/731,351

(22) Filed: Dec. 9, 2003

(65) Prior Publication Data

US 2004/0112340 A1 Jun. 17, 2004

(30) Foreign Application Priority Data

Dec. 13, 2002 (JP) ..... 2002-362269

(51) Int. Cl.[7] ..... F02M 41/00
(52) U.S. Cl. ..... 123/456; 123/458
(58) Field of Search ..... 123/511, 512, 123/513, 514, 456, 458

(56) References Cited

U.S. PATENT DOCUMENTS 4,719,889 A * 1/1988 Amann et al. ..... 123/447
4,884,545 A * 12/1989 Mathis ..... 123/447
5,411,002 A * 5/1995 Smitley ..... 123/497
5,927,322 A * 7/1999 Rosenau ..... 137/487.5
6,273,067 B1 * 8/2001 Bazinet ..... 123/458
6,311,674 B1 * 11/2001 Igashira et al. ..... 123/458
6,367,452 B1 * 4/2002 Shima et al. ..... 123/457

FOREIGN PATENT DOCUMENTS

JP 63-050649 3/1998
JP 11-030150 2/1999

* cited by examiner

*Primary Examiner*—Mahmoud Gimie
(74) *Attorney, Agent, or Firm*—McCormick, Paulding & Huber LLP

(57) ABSTRACT

The common rail fuel injection control device in accordance with the present invention computes a base duty (A) equivalent to a base target opening degree of a metering valve and a correction coefficient (B) based on the engine operation state, adds the value obtained by multiplying an oscillation duty (C) which oscillates periodically by the correction coefficient (B) to the base duty (A), and determines the final duty (D) equivalent to a final target opening degree of the metering valve.

10 Claims, 6 Drawing Sheets

M5:CORRECTION COEFFICIENT COMPUTATION MAP

COMMON RAIL FUEL INJECTION CONTROL DEVICE

CROSS REFERENCE TO RELATED APPLICATION

Applicants hereby claim foreign priority benefits under U.S.C. §119 of Japanese Patent Application No. 2002-362269, filed Dec. 13, 2002, and the content of which is herein incorporated by reference.

BACKGROUND OF THE INVENTION

1. Field of the Invention

The present invention relates to a common rail fuel injection control device suitable for diesel engines, more specifically to a method for controlling a metering valve for adjusting the quantity of fuel pumped into the common rail.

2. Description of the Related Art

In common rail fuel injection control devices for diesel engines, high-pressure fuel with a pressure increased to an injection pressure (for example, from several tens to several hundreds of MPa) is accumulated in a common rail at a pressure, and this fuel is injected into cylinders by opening the valves of injectors. As for fuel supply into the common rail, fuel pumping is conducted with a supply pump serving as a high-pressure pump, and the quantity of fuel flowing into the supply pump is adjusted with a metering valve. The opening degree of the metering valve is controlled according to the drive signal supplied from a controller, and the quantity of supplied fuel is thus controlled. As a result, the common rail pressure is controlled. The metering valve is composed, for example, of an electromagnetic valve of a spool valve type.

A process for controlling the quantity of fuel supplied to the supply pump and thereby controlling the quantity of fuel pumped by the supply pump and controlling the common rail pressure has already been known (for example, Japanese Patent Applications Laid-open No. H11-30150 and S63-50469).

However, the problem associated with such a common rail fuel injection system was that valve sticking occurred when the engine operation state (for example, idling) with a constant opening degree of the metering valve was maintained. In other words, because an action overcoming a static friction force is required to move the valve from a state in which it was stopped in a fixed position, comparatively large changes in electric current have to be induced. Furthermore, if the state with a constant valve opening degree is maintained for a certain time, lubrication in the sliding parts of the valve is further degraded and the trend to valve sticking is further increased (the static friction force increases). As a result, the responsiveness of the valve to current changes is degraded.

This will be explained with reference to FIG. 6. In the figure an electric current fed to the metering valve is plotted against the abscissa, and the opening degree of the metering valve is plotted against the ordinate.

The figure shows that, for example, an electric current i2 is required (point I) to open the metering valve from a completely closed state to an opening degree V. When the valve opening degree remains constant for a comparatively long time in this state, a comparatively large current change Δi becomes required to actuate the metering valve thereafter in the closing direction. In other words, the valve starts moving in the closing direction from the point in time (point II) in which the electric current fed to the metering valve is decreased by Δi from i2 to i1. Therefore, the interval with current changes Δi becomes a non-sensitive zone in which the valve opening degree does not change in response to changes in the electric current.

When the non-sensitive zone caused by valve sticking thus occurs, even if the electric current value is changed with the object of causing transitional changes in the common rail pressure, the responsiveness of the metering valve to changes in the electric current valve is poor. As a result, inadequate tracing of common rail pressure occurs.

SUMMARY OF THE INVENTION

The present invention was conceived with the above-described problems in view and it is an advantage thereof to prevent the metering valve from sticking and to improve traceability of common rail pressure.

In accordance with the first aspect of the present invention, there is provided a common rail fuel injection control device which comprises a supply pump for pumping a fuel into a common rail and a metering valve for adjusting the fuel pumping quantity in the supply pump and in which the metering valve is controlled to a base target opening degree determined based on the engine operation state by a duty drive signal, wherein the duty drive signal is caused to oscillate periodically.

With such a configuration, the metering valve can be prevented from sticking and traceability of common rail pressure can be improved.

The oscillation range of the duty drive signal may be caused to change according to the engine operation state.

In accordance with the second aspect of the present invention, there is provided a common rail fuel injection control device comprising a common rail for accumulating a high-pressure fuel, a supply pump for pumping the fuel into the common rail, a metering valve for adjusting the fuel pumping quantity in the supply pump, means for detecting the engine operation state, means for detecting an actual common rail pressure, means for computing a target common rail pressure based on the engine operation state, and means for controlling the opening degree of the metering valve by a duty drive signal so that the pressure difference between the target common rail pressure and the actual common rail pressure becomes zero, this control device additionally comprising means for determining the value of a base duty equivalent to a base target opening degree of the metering valve based on the pressure difference, means for generating the value of an oscillation duty which oscillates with a constant period and a constant amplitude, and means for determining the value of a final duty which is equivalent to a final target opening degree of the metering valve and has to be applied to the metering valve by adding the value of the oscillation duty to the value of the base duty.

Here, the control device may also comprise means for determining a correction coefficient based on the engine operation state and means for determining the value of the final duty by adding the value obtained by multiplying the value of the oscillation duty by the correction coefficient to the value of the base duty.

Further, the target common rail pressure and the correction coefficient may be determined based on the engine revolution speed, and the target fuel injection quantity determined by the engine revolution speed and accelerator opening degree.

It is preferred that the correction coefficient be set so as to assume a smaller value as the engine revolution speed increases and also to assume a smaller value as the target fuel injection quantity increases.

It is preferred that the correction coefficient be set so as to become zero when the engine revolution speed is not less than the prescribed value and when the target fuel injection quantity is not less than the prescribed value.

DESCRIPTION OF THE PREFERRED EMBODIMENTS

The preferred embodiment of the present invention will be described hereinbelow with reference to the accompanying drawings.

Figure 3:
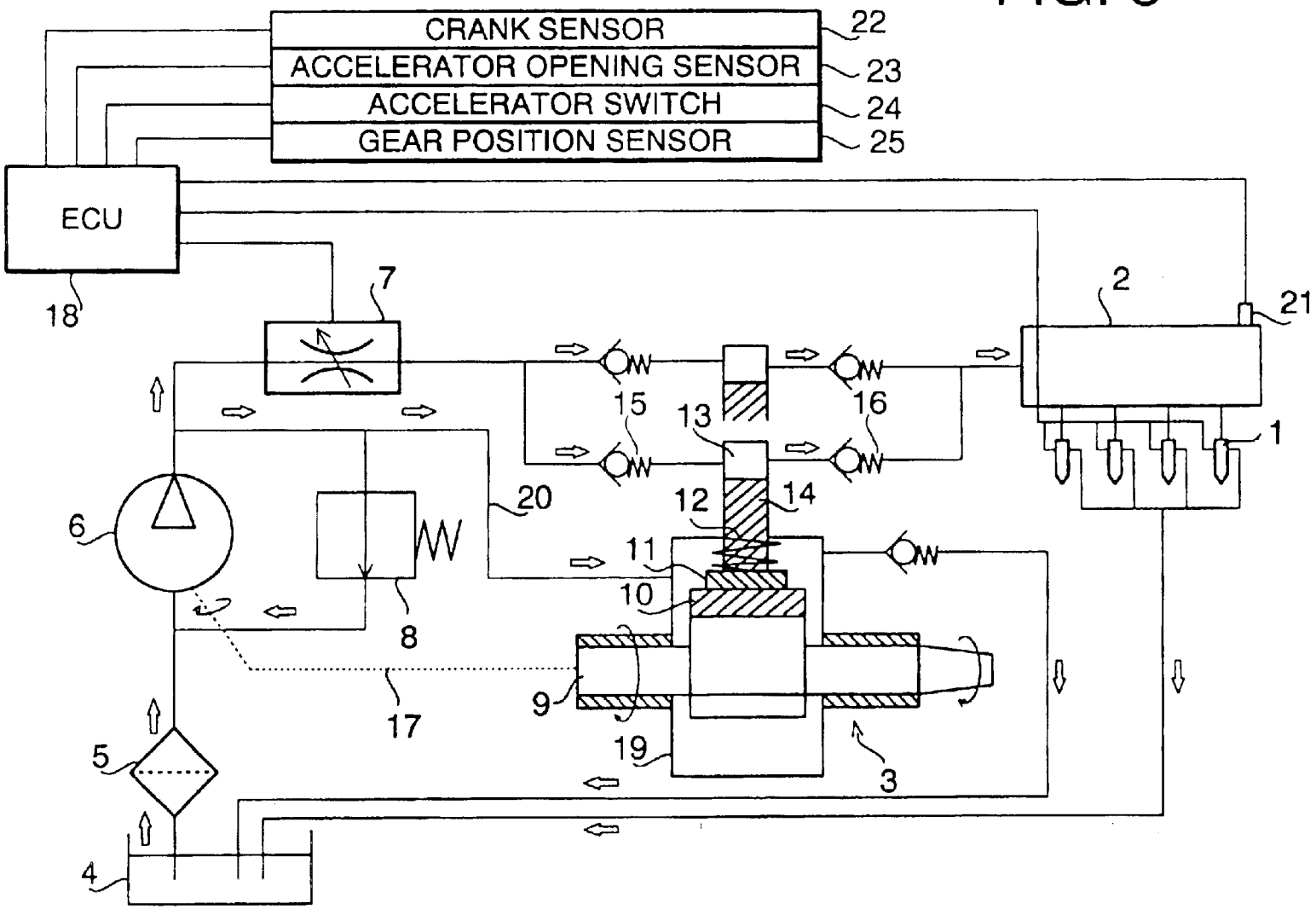
FIG. 3 is a system drawing of a common rail fuel injection control device of the present embodiment.

FIG. 3 shows the entire configuration of the common rail fuel injection control device of the present embodiment. This device is employed for executing fuel injection control in a four-cylinder diesel engine (not shown in the figure) carried on a vehicle.

An injector 1 is provided in each cylinder of the engine, and a high-pressure fuel under a common-rail pressure (from several tens to several hundreds of MPa), which is stored in a common rail 2, is regularly supplied to each injector 1. Pumping of fuel into the common rail 2 is carried out by a supply pump 3. Thus, a fuel (light oil) at about a normal pressure which is present in a fuel tank 4 is sucked in by a feed pump 6 via a fuel filter 5 and transferred from the feed pump 6 into the supply pump 3. The supply pump 3 applies pressure to the fuel and pumps it into the common rail 2.

A metering valve 7 for adjusting the quantity of fuel supplied into the supply pump 3 and, therefore; the quantity of fuel pumped into the common rail 2 is installed between the feed pump 6 and the supply pump 3. The metering valve 7 is composed of an electromagnetic valve of a spool valve type, as described hereinbelow. Furthermore, a relief valve 8 for adjusting the outlet pressure of the feed pump 6 is provided in parallel with the feed pump 6.

The supply pump 3 is mainly composed of a pump shaft 9 driven synchronously by the engine, a cam ring 10 fit on the outer periphery of the pump shaft 9, a tappet 11 in a sliding contact with the outer periphery of the cam ring 10, a pressure spring 12 for pressing the tappet 11 against the cam ring 10, a plunger 14 which is lifted at the same time as the tappet 11 is lifted by the cam ring 10 and applies pressure to the fuel in a plunger chamber 13, and check valves 15, 16 provided respectively in the inlet portion and outlet portion of the plunger chamber 13.

The tappet 11, pressure spring 12, plunger chamber 13, plunger 14, and check valves 15, 16 constitute a pumping unit. Two such pumping units are provided with a 180° spacing around the pump shaft 9. As a result, the supply pump 3 pumps the fuel twice per one pump revolution. For the sake of convenience, in the figure, the two pumping units are shown in a plan view thereof.

The pump shaft 9 of the supply pump 3 and the pump shaft (not shown in the figure) of the feed pump 6 are connected to the engine with mechanical connection means 17 such as a chain mechanism, a belt mechanism, or a gear mechanism. As a result, the supply pump 3 and the feed pump 6 are driven synchronously by the engine.

The supply pump 3 is rotary driven at a revolution ratio of 1:1 with the engine, and pumping of the fuel is conducted periodically at a ratio of two times per one revolution of the crankshaft. As described hereinabove, the engine has four cylinders, and fuel pumping by the supply pump 3 and fuel injection by the injectors 1 are synchronized. The common rail pressure is increased by pumping the fuel from the supply pump 3, and the common rail pressure is decreased by fuel injection from injectors. In another possible embodiment, a reduction valve is provided in a common rail 2 and the common rail pressure is rapidly decreased by opening the reduction valve.

The flow of fuel in this device is shown by arrows in FIG. 3. Thus, the fuel present in the fuel tank 4, is supplied, after passing through the fuel filter 5, into the feed pump 6 and then into the metering valve 7. The outlet pressure of the feed pump 6 is adjusted by the relief valve 8, and the excess fuel that has passed through the relief valve 8 returns to the inlet side of the feed pump 6. The degree of opening and the opening/closing timing of the metering valve 7 are controlled by an electronic control unit (referred to hereinbelow as ECU) 18 serving as a controller. When the valve is open, the fuel is discharged toward the pumping unit of the supply pump 3 in an amount corresponding to the degree of opening and the opening period.

The discharged fuel pushes and opens the inlet check valve 15 and is introduced into the plunger chamber 13. The lift of the plunger 14 raises the pressure, and once the pressure rises to a level exceeding the opening pressure of the outlet check valve 16, the fuel pushes and opens the outlet check valve 16 and is introduced into the common rail 2. As a result, the common rail pressure is increased by the amount balanced with the quantity of fuel discharged from the metering valve 7. The fuel present in the common rail 2 is constantly supplied to the injectors 1, and when the injectors 1 are open, the fuel of the common rail 2 is injected into the cylinders.

The leak fuel discharged from the injectors 1, for example, due to opening/closing control of the injectors 1 is directly returned into the fuel tank 4. Furthermore, the fuel at the outlet side of the feed pump 6 is introduced into a casing 19 of the supply pump 3 via a pipeline 20, and each sliding part in the supply pump 3 is lubricated with the fuel.

The ECU 18 conducts overall electronic control of the device, the opening/closing control of the injectors 1 being mainly executed based on the operation state (for example, engine revolution speed, engine load, and the like) of the engine. Fuel injection is implemented and terminated according to ON/OFF state of the electromagnetic solenoids of injectors 1.

Furthermore, the ECU 18 also controls the opening degree and opening/closing timing of the metering valve 7 according to the operation state of the engine, thereby conducting feedback control of common rail pressure. Thus, the target common rail pressure based on the engine operation state is determined by the ECU 18, and the metering valve 7 is controlled by the ECU 18 so that the actual common rail pressure matches the target common rail pressure. For example, if the actual common rail pressure becomes less than the target common rail pressure by a comparatively large amount, the metering valve 7 is controlled so that the opening degree thereof is increased and the amount of fuel pumped from the supply valve 3 is increased.

A variety of sensors are provided to detect the operation state of the engine and the vehicle carrying the engine. Those sensors include a crank sensor 22 for detecting the crank angle of the engine, an accelerator opening degree sensor 23 for detecting the accelerator opening degree, an accelerator switch 24 for detecting whether the accelerator opening degree is 0 or not, and a gear position sensor 25 for detecting the gear position (including neutral) of the transmission. Those sensors are electrically connected to the ECU 18. Further, the ECU 18 computes the engine revolution speed based on the output pulse of the crank sensor 22. In addition, a pressure sensor 21 for detecting the actual common rail pressure is provided in the common rail 2, and this pressure sensor 21 is also electrically connected to the ECU 18.

The opening degree of the metering valve 7 is controlled by the drive signal, in particular the duty drive signal, supplied from the ECU 18. A Pulse Width Modulation (PWM) circuit for generating the duty drive signal is provided in the ECU 18. Further, the duty ratio, as referred to in the present embodiment, stands for a ratio of ON time per one period (unit time).

Figure 1:
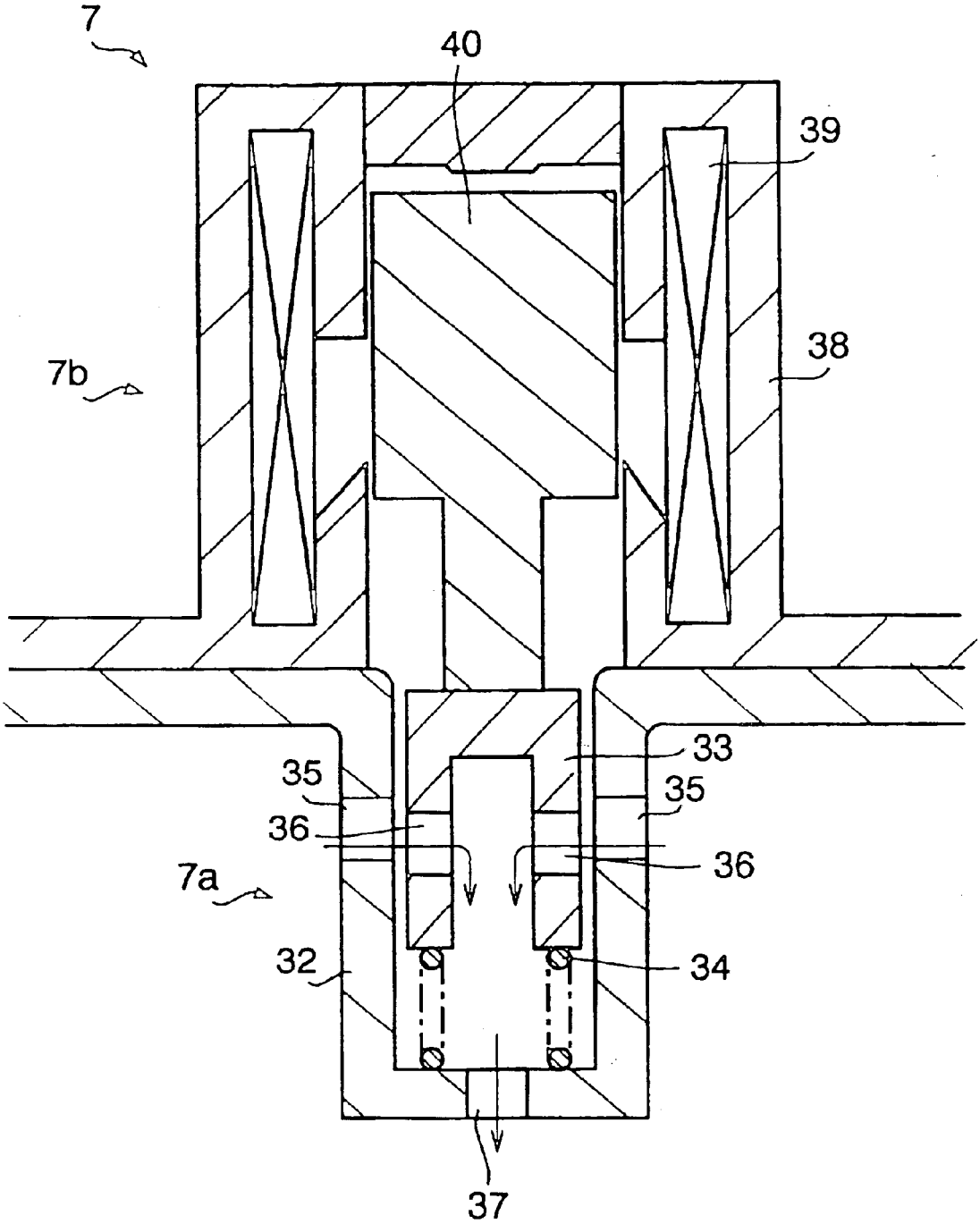
FIG. 1 is a longitudinal section view of a metering valve.

The structure of the metering valve 7 is shown in FIG. 1. The metering valve 7 is mainly composed of a metering section 7*a* shown in the lower part of the figure and an actuator section 7*b* shown in the upper part of the figure. The metering valve is of a normally-open system and is completely open in the OFF state (no current is passed). The metering section 7*a* accommodates an open-bottom cylindrical valve piece 33 serving as a valve and a return spring 34 inside a cylindrical valve body 32. When the valve piece 33 slides in the axial direction inside the valve body 32, the connection surface area of the inlet hole 35 provided in the side wall of the valve body 32 and an introducing hole 36 provided in the valve piece 33 changes and the valve opening degree is changed. The return spring 34 is disposed in a compressed state between the lower end surface of the valve piece 33 and the bottom wall of the valve body 32 and forces the valve piece 33 to move upward, that is, in the valve opening direction.

The fuel supplied from the feed pump 6 is introduced from the inlet hole 35, guided downward inside the valve piece 33, and ejected toward the supply pump 3 from an outlet hole 37 provided in the bottom wall of the cylindrical section 32.

In the actuator section 7*b*, a coil-shaped electromagnetic solenoid 39 is embedded in a solenoid case 38, and an armature 40 is disposed, so that it can slide in the axial direction, in the open space in the central portion of the solenoid case 38. The armature 40 is surrounded from the outside with the electromagnetic solenoid 39 and is driven downward when the electromagnetic solenoid 39 is ON (current is passed), thereby driving the valve piece 33 in the valve opening direction. The armature 40 and the valve piece 33 are usually brought into intimate contact with each other by the electromagnetic force created by the electromagnetic solenoid 39 and the impelling force of the return spring 34 and can be considered as a single valve. Sliding portions on the outer peripheral surface of the armature 40 and the valve piece 33 are lubricated by the fuel that permeated into the valve.

Figures 2A, 2B, 2C:
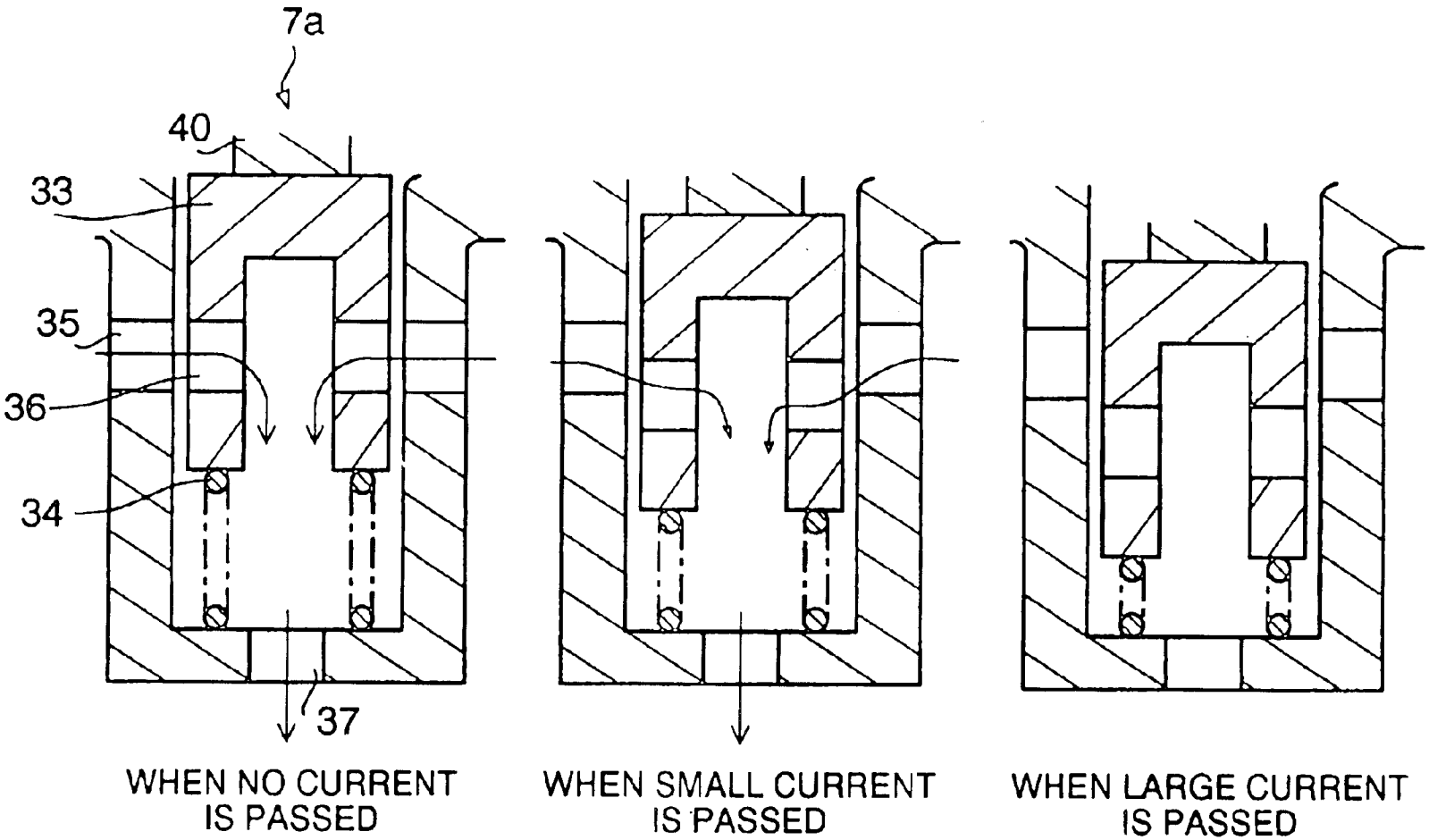
FIG. 2 is a longitudinal section view showing the actuation state of the metering valve.

Each state of the metering section 7*a* of the metering valve 7 is illustrated in FIGS. 2A, 2B and 2C. FIG. 2A is a state in which no electric current is passed in the electromagnetic solenoid, the inlet hole 35 and introducing hole 36 are completely linked together, and a maximum valve opening degree (completely opened valve) is attained. FIG. 2B is a state in which a small electric current flows, the inlet hole 35 and introducing hole 36 are partially linked together, and an intermediate valve opening degree is attained. FIG. 2C is a state in which a large electric current flows, the inlet hole 35 and introducing hole 36 are not linked together, and a minimum valve opening degree (completely closed valve) is attained. In the latter case, no fuel pumping is conducted by the supply pump 3. The value of electric current flowing in the electromagnetic solenoid changes according to the duty ratio, and the opening degree of the metering valve 7 changes continuously from a completely open state to a completely closed state.

Figure 7:
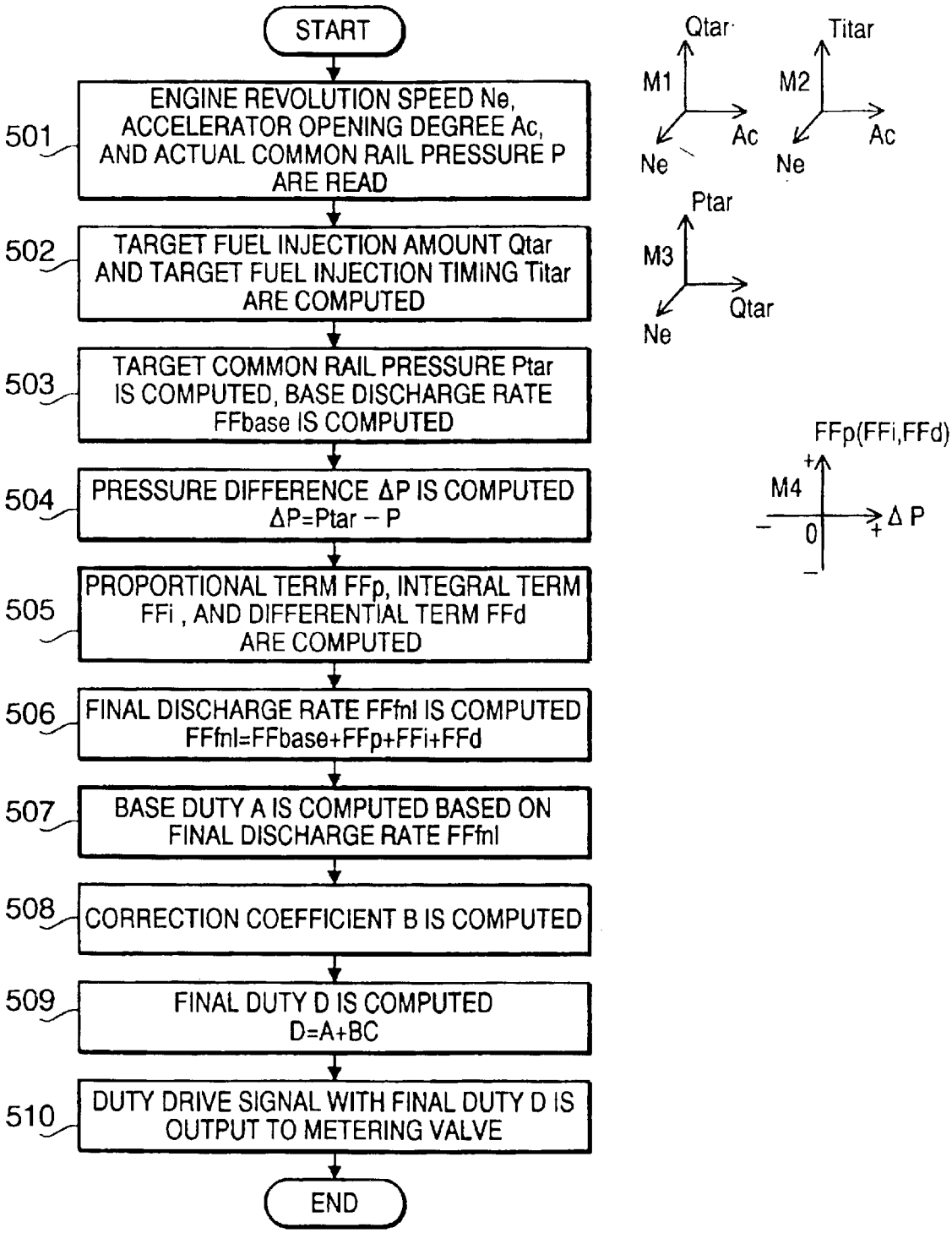
FIG. 7 is a flow chart illustrating the contents of feedback control of common rail pressure.

A method for feedback control of the common rail pressure of the present embodiment will be described below with reference to FIG. 7. The processing flow shown in the figure is repeatedly executed by the ECU 18 with a control timing for each prescribed control period Δt (for example, 20 msec). A map for computing the below-described control values is created based on the results of actual engine tests conducted in advance and is stored in the ECU 6.

In step 501, an engine revolution speed Ne calculated based on the output pulse of the crank sensor 22, an accelerator opening degree Ac detected by the accelerator opening sensor 23, and an actual common rail pressure P detected by the pressure sensor 21 are read.

In step 502, a target fuel injection amount Qtar and a target fuel injection timing Titar are computed according to a target fuel injection amount computation map M1 and a target fuel injection timing computation map M2 based on the values of the engine revolution speed Ne and accelerator opening degree Ac. The target fuel injection amount Qtar and the target fuel injection timing Titar that are computed may be corrected according to engine temperature or atmospheric pressure.

In step 503, a target common rail pressure Ptar is computed according to a target common rail pressure computation map M3 based on the values of the engine revolution speed Ne and the target fuel injection amount Qtar. A base discharge rate FFbase of the supply pump is computed from the target fuel injection amount Qtar and the amount of leak from the injectors In step 504, the difference ΔP between the target common rail pressure Ptar and the actual common rail pressure P is computed by the formula ΔP=Ptar−P.

In step 505, a proportional term FFp, an integral term FFi, and a differential term FFd are computed according to respective proportional term computation map, integral term computation map, and differential term computation map (all those maps are denoted together as M4) based on the pressure difference ΔP.

In step 506, each of the proportional term FFp, integral term FFi, and differential term FFd is added to the base discharge rate FFbase, and a final discharge rate FFfnl is computed.

The base discharge rate FFfnl is a target value of the final discharge rate of the supply pump. Accordingly, in step 507, the base duty A, that is, the duty ratio of the duty drive signal corresponding to the base target opening degree of metering valve 7, is computed based on the final discharge rate FFfnl.

In other words, the pressure difference ΔP is computed based on the engine operation state represented by the engine revolution speed Ne and accelerator opening degree Ac (steps 501–504) and the base duty A is computed based on the pressure difference ΔP (steps 505–507). Therefore, finally, the base duty A becomes the value computed based on the engine operation state.

The correction of the base duty A, which is the specific feature of the present invention, is conducted in the below-described steps 508, 509.

Figure 5:
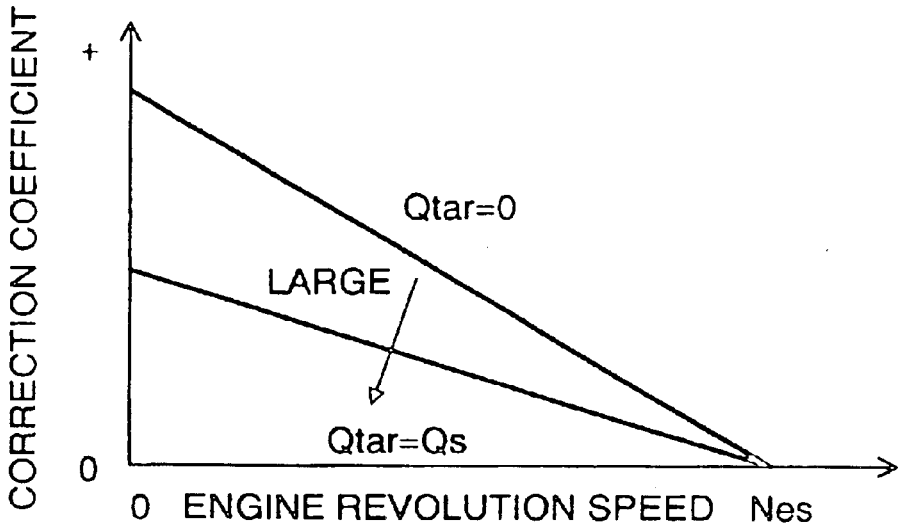
FIG. 5 is a correction coefficient computation map.

First, in step 508, a correction coefficient B is computed according to a correction coefficient computation map M5 shown in FIG. 5, based on the engine revolution speed Ne and target fuel injection quantity Qtar. The map M5 clearly shows that the value of correction coefficient B is set so as to decrease as the engine revolution speed Ne becomes higher and so as to decrease as the target fuel injection quantity Qtar becomes larger. In the present embodiment, when the target fuel injection quantity Qtar is made constant within a range of $0 \leqq Qtar \leqq Qs$ (Qs is the prescribed threshold value, for example, Qs=60 $mm^3$/st), the correction coefficient B satisfies the inverse proportional relationship with the engine revolution speed Ne, while the engine revolution speed Ne is from zero to the prescribed threshold value Nes (for example Nes=2000 rpm), and becomes zero when the engine revolution speed Ne assumes the threshold value Nes or a higher value. Further, when the engine revolution speed Ne is constant within a range $0 \leqq Ne \leqq Nes$, the correction coefficient B reaches maximum when the target fuel injection quantity Qtar is zero and the correction coefficient B becomes zero (minimum) when the target fuel injection quantity Qtar is a threshold value Qs or a higher value. Thus, the correction coefficient B can be computed based on the engine revolution speed Ne and target fuel injection quantity Qtar which are the parameters identical to those considered in the case of target common rail pressure Ptar.

Figure 4:
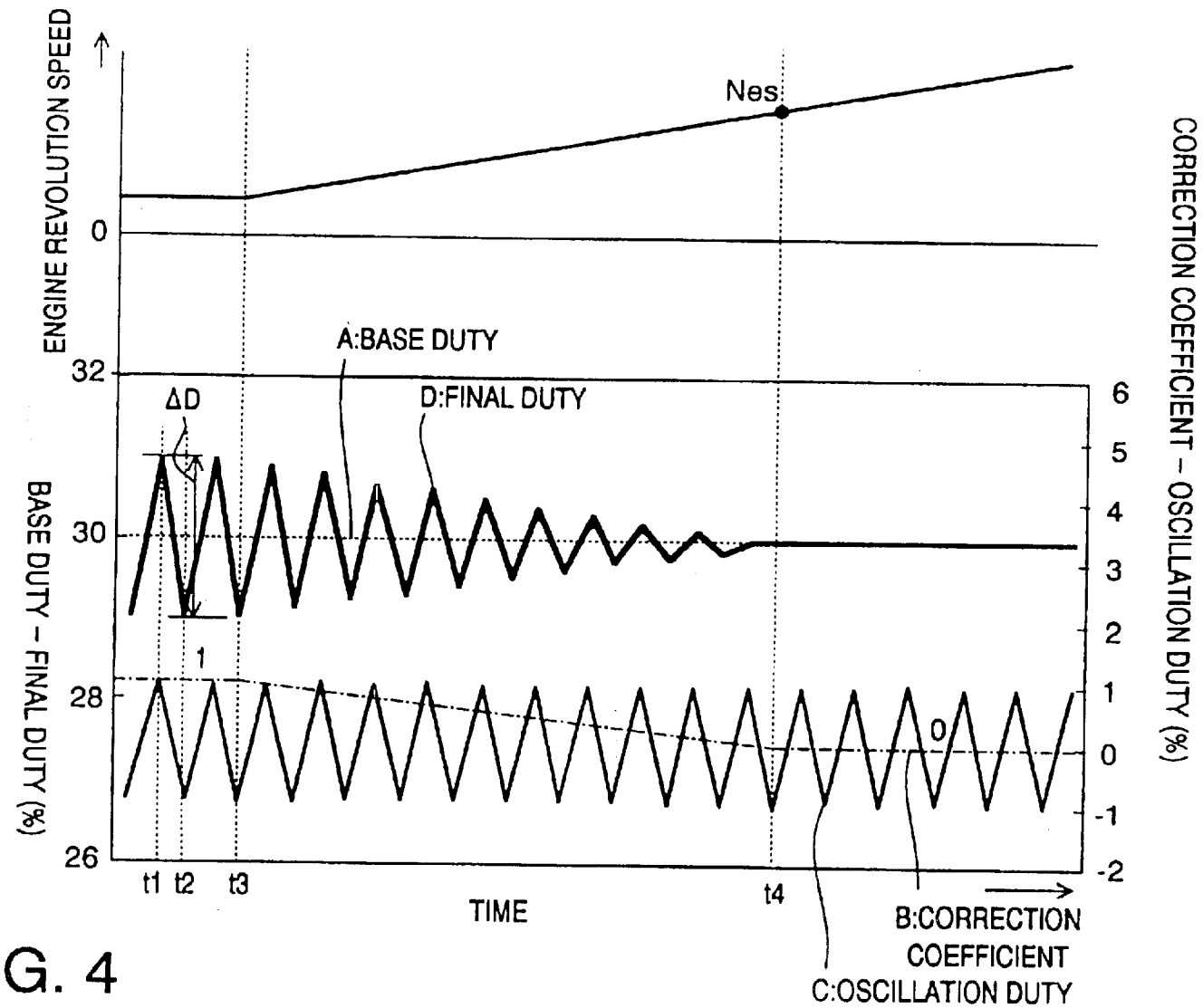
FIG. 4 is a time chart for explaining the correction method of a base duty.

In step 509, the value of a final duty D which is to be actually applied to the metering valve 7 of the supply pump 3 is computed based on the formula D=A+BC. Here, C is an oscillation duty such as shown in FIG. 4, it oscillates with a constant period and a constant amplitude. The oscillation duty C is a value generated inside the ECU 18. In the present embodiment, the oscillation duty C oscillates within a range from −1 (%) to 1 (%) with zero as the center. The base duty A is thus corrected by the product of the correction coefficient B and the oscillation duty C, and the final duty D thus obtained is a duty ratio equivalent to the final target opening degree of the metering valve 7 which is to be controlled.

In step 510, a duty drive signal having a duty ratio equal to the final duty D is output to the metering valve 7. The present control cycle is thus completed.

Correction of the base duty A will be described below with reference to FIG. 4. The example shown in the figure relates to the case in which the base duty A computed in the aforesaid step 507 is A=30 (%). In this case, as shown in the figure, due to changes in the engine revolution speed, the correction coefficient B starts decreasing from 1 at time t3 and becomes zero at time t4 because the engine revolution speed reaches Nes.

The final duty D is obtained by adding the value obtained by multiplying the value of the oscillation duty C by the correction coefficient B to the value of the base duty A. For example, at time t1, the correction coefficient B=1 and the oscillation duty C=1 (%). Therefore, the final duty D=1×1 (%)+30 (%)=31 (%). Furthermore, for example, at time t2, the correction coefficient B=1 and the oscillation duty C=−1 (%). Therefore, the final duty D=1×−1(%)+30 (%)=29 (%). The final duty D thus oscillates with the same period as the oscillation duty C. The oscillation range is ΔD shown in FIG. 4.

After time t3, the oscillation range of the final duty D gradually decreases because of the decrease in the correction coefficient B. Because the correction coefficient B becomes zero after time t3, the oscillations of the final duty D are also terminated. The time-average value of the final duty D in the above-described process is still the base duty A=30 (%), and the final duty D oscillates according to the correction coefficient B about this value as a center.

Figure 6:
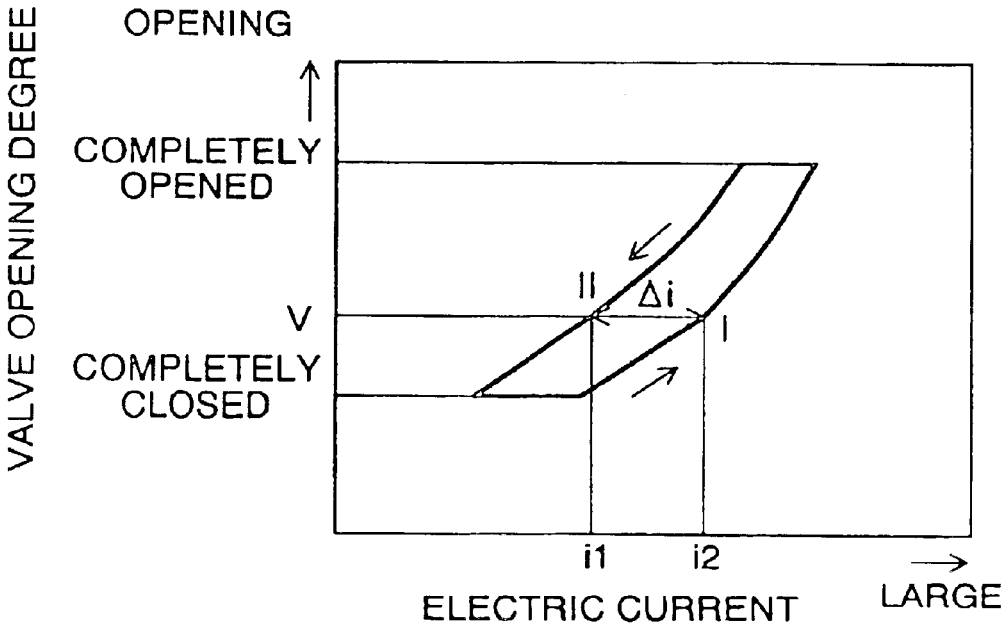
FIG. 6 is diagram for explaining sticking of the metering valve.

Thus, because the duty drive signal (final duty D) output to the metering valve 7 oscillates with the prescribed period, the valve piece 33 (see FIG. 1) of the metering valve 7 slightly vibrates even in the engine operation state in which the valve opening degree of the metering valve 7 becomes constant. Therefore, sticking of the metering valve 7 caused by static friction can be prevented, good responsiveness of the metering valve 7 to changes in the electric current value can be obtained, and the common rail pressure traceability is improved. In other words, the non-sensitive zone Δi shown in FIG. 6 can be eliminated or greatly reduced.

Further, in the present embodiment, the oscillation range ΔD of the final duty D increases with the decrease in the engine revolution speed and decrease in the target fuel injection quantity Qtar. Valve sticking usually occurs when the pumping frequency is low as at the time of low rpm, when the quantity of fuel flowing into the metering valve 7 is comparatively small as at the time of low load, and during idling when the engine operation state is constant. Therefore, the above-described settings can effectively prevent the valve from sticking. Conversely, when rpm and load are high, the pumping frequency is high, the valve vibrates by itself, and the quantity of fuel flowing into the metering valve 7 is comparatively large. As a result, valve sticking can hardly occur. Therefore, in such a case, no problem occurs even without oscillations. Conversely, because in this case the sensitivity of metering valve 7 is high, creating the oscillations can cause common rail pressure hunting. Accordingly, it is desirable not to cause any oscillations.

Furthermore, the correction coefficient B is computed based on the parameters (engine revolution speed Ne and target fuel injection quantity Qtar) identical to those used in computing the target common rail pressure Ptar, thereby providing for compatibility with the control and leading to control stability.

Other embodiments of the present invention can be also considered, and the present invention is not limited to the above-described embodiment.

The common rail fuel injection control device of the present embodiment exhibits excellent effect by preventing the metering valve from sticking and increasing the common rail pressure traceability.

What is claimed is:

1. A common rail fuel injection control device comprising:

a supply pump for pumping fuel into a common rail;

a metering valve for adjusting a fuel pumping quantity in the supply pump, wherein the metering valve is controlled to an opening degree by a duty drive signal;

means for determining a value of a base duty according to an engine operation state, said base duty associated with a base target opening degree of said metering valve;

means for determining a value of a final duty, said value of said final duty oscillating periodically around the value of said base duty; and means for supplying said duty drive signal with the value of said final duty to said metering valve.

2. The common rail fuel injection control device according to claim 1, wherein an oscillation range of the value of said final duty is caused to change according to the engine operation state.

3. A common rail fuel injection control device comprising:

a common rail for accumulating a high-pressure fuel;

a supply pump for pumping the fuel into the common rail;

a metering valve for adjusting a fuel pumping quantity in the supply pump;

means for detecting an engine operation state;

means for detecting an actual common rail pressure;

means for computing a target common rail pressure based on the engine operation state; and means for controlling an opening degree of the metering valve by a duty drive signal so that a pressure difference between said target common rail pressure and said actual common rail pressure becomes zero, means for determining a value of a base duty equivalent to a base target opening degree of said metering valve based on said pressure difference;

means for generating a value of an oscillation duty which oscillates with a constant period and a constant amplitude; and means for determining a value of a final duty which has to be applied to said metering valve by adding the value of said oscillation duty to the value of said base duty.

4. The common rail fuel injection control device according to claim 3, further comprising:

means for determining a correction coefficient based on the engine operation state; and means for determining a value of said final duty by adding a value obtained by multiplying the value of said oscillation duty by said correction coefficient to the value of said base duty.

5. The common rail fuel injection control device according to claim 4, wherein said target common rail pressure and said correction coefficient are determined based on an engine revolution speed, and a target fuel injection quantity determined by the engine revolution speed and accelerator opening degree.

6. The common rail fuel injection control device according to claim 4, wherein said correction coefficient is set so as to assume a smaller value as engine revolution speed increases and also to assume a smaller value as target fuel injection quantity increases.

7. The common rail fuel injection control device according to claim 5, wherein said correction coefficient is set so as to assume a smaller value as said engine revolution speed increases and also to assume a smaller value as said target fuel injection quantity increases.

8. The common rail fuel injection control device according to claim 4, wherein said correction coefficient is set so as to become zero when engine revolution speed is not less than the prescribed value and when target fuel injection quantity is not less than the prescribed value.

9. The common rail fuel injection control device according to claim 5, wherein said correction coefficient is set so as to become zero when said engine revolution speed is not less than the prescribed value and when said target fuel injection quantity is not less than the prescribed value.

10. The common rail fuel injection control device according to claim 6, wherein said correction coefficient is set so as to become zero when said engine revolution speed is not less than the prescribed value and when said target fuel injection quantity is not less than the prescribed value.

* * * * *